US007626476B2

(12) United States Patent
Kim et al.

(10) Patent No.: US 7,626,476 B2
(45) Date of Patent: Dec. 1, 2009

(54) MULTI-METAL COPLANAR WAVEGUIDE

(75) Inventors: Cheon Soo Kim, Daejeon (KR); Myung Shin Kwak, Daejeon (KR); Seong Do Kim, Daejeon (KR); Mun Yang Park, Daejeon (KR); Hyun Kyu Yu, Daejeon (KR); Hee Bum Jung, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 60 days.

(21) Appl. No.: 11/690,219

(22) Filed: Mar. 23, 2007

(65) Prior Publication Data

US 2007/0241844 A1 Oct. 18, 2007

(30) Foreign Application Priority Data

Apr. 13, 2006 (KR) ..... 10-2006-0033587

(51) Int. Cl.
*H01P 3/08* (2006.01)

(52) U.S. Cl. ..... 333/238; 333/33

(58) Field of Classification Search ..... 333/33, 333/34, 238, 246, 236, 245
See application file for complete search history.

(56) References Cited

U.S. PATENT DOCUMENTS

| | | | | |
|---|---|---|---|---|
| 4,914,407 | A | 4/1990 | Itoh | |
| 5,305,519 | A | 4/1994 | Yamamoto et al. | |
| 6,198,456 | B1 | 3/2001 | Le Halle et al. | |
| 6,271,137 | B1 | 8/2001 | Liou et al. | |
| 6,465,367 | B1 | 10/2002 | Tsai | |
| 6,518,864 | B1 * | 2/2003 | Ito et al. | 333/238 |
| 6,950,590 | B2 | 9/2005 | Cheung et al. | |
| 7,307,497 | B2 * | 12/2007 | Joodaki | 333/238 |
| 2002/0168871 | A1 | 11/2002 | Tsai | |

FOREIGN PATENT DOCUMENTS

| | | |
|---|---|---|
| JP | 11-308001 | 11/1999 |
| JP | 2000-252712 | 9/2000 |
| JP | 2004-023192 | 1/2004 |
| KR | 100154720 | 7/1998 |

(Continued)

OTHER PUBLICATIONS

Doan, C.H., et al., "Millimeter-Wave CMOS Design." Jan. 2005. *IEEE Journal of Solid-State Circuits*, vol. 40, No. 1, pp. 144-155.

(Continued)

*Primary Examiner*—Stephen E Jones
(74) *Attorney, Agent, or Firm*—Ladas & Parry LLP

(57) ABSTRACT

A coplanar waveguide CPW using multi-layer interconnection CMOS technology is provided. In the CPW including an interlayer insulator disposed on a substrate, metal multilayers disposed on the interlayer insulator, and a ground line-a signal line-a ground line formed of an uppermost metal layer, when a ground line of a lowermost layer is connected to the ground line of the uppermost layer, intermediate metal layers are designed to gradually increase or decrease in width, or to be uneven so as to maximize an area where an ultra-high frequency spreads, thereby minimizing CPW loss and maximizing a slow wave effect. As a result, it is possible to improve performance of an ultra-high frequency circuit and miniaturize the circuit.

6 Claims, 5 Drawing Sheets

FOREIGN PATENT DOCUMENTS

KR 10-2000-0019704 4/2000

OTHER PUBLICATIONS

Cheung, T.S.D., et al., "On-Chip Interconnect for mm-Wave Applications Using an All-Copper Technology and Wavelength Reduction." 2003. *IEEE International Solid-State Circuits Conference, Session 22, TD: Embedded Technologies, Paper 22.6.*

Komijani, A., et al., "A 24-GHz, +14.5-dBm Fully Integrated Power Amplifier in 0.18-μm CMOS." Sep. 2005. *IEEE Journal of Solid-State Circuits*, vol. 40, No. 9, pp. 1901-1908.

* cited by examiner

MULTI-METAL COPLANAR WAVEGUIDE

CROSS-REFERENCE TO RELATED APPLICATION

This application claims priority to and the benefit of Korean Patent Application No. 2006-0033587, filed Apr. 13, 2006, the disclosure of which is incorporated herein by reference in its entirety.

BACKGROUND

1. Field of the Invention

The present invention relates to a multi-metal coplanar waveguide (CPW) which can enhance fidelity and minimize loss of a CPW by designing a ground line in various shapes when a CPW transmission line is designed using multi-layer interconnection CMOS technology in order to apply to the design of a CMOS IC operating at ultra high frequency.

2. Discussion of Related Art

In design of a conventional CPW using multi-layer interconnection CMOS technology, a method of designing an uppermost metal layer to have a ground-signal-ground line structure has been used. In addition, a method of shielding the CPW by inserting a ground line below the CPW as a lowermost metal layer in order to reduce a CPW loss caused by a silicon substrate and a method of shielding the CPW using patterned ground lines have been used. Moreover, a method of connecting ground lines of uppermost and lowermost layers using intermediate metal layers and via holes has been widely used.

In the CPW, a transmission signal is sensitive to a shape and pattern of a ground line as well as the width of a signal line and the distance between the signal line and ground lines.

As CMOS technology has rapidly developed, RFICs operating at radio frequency have been actively commercialized and recently attracting attention as technology applicable to the higher millimeter wave band. In millimeter wave band IC design, a transmission line is a basic passive element transmitting signals and having a capacitance and an inductance.

However, when the transmission line and the CPW are designed by multi-layer interconnection CMOS technology, because the distance between the signal line and ground lines cannot be large, they have low fidelity and a signal is largely attenuated by a conductive silicon substrate.

SUMMARY OF THE INVENTION

The present invention is directed to providing various structures of ground lines applicable to a CPW using multi-layer interconnection CMOS technology, the structures increasing fidelity and reducing attenuation of a CPW to enhance performance of a millimeter wave CMOS IC.

The present invention is also directed to a CPW that is capable of minimizing CPW loss and improving fidelity by maximizing an area of electromagnetic wave propagation using a method of decreasing widths of intermediate metal layers from the ground line of the uppermost layer to a lowermost layer, a method of increasing widths of intermediate metal layers from an intermediate metal layer disposed just below the ground line of the uppermost layer to the lowermost layer, a method of using intermediate metal layers having a narrow width compared to the ground line of the uppermost layer, or a method of connecting intermediate metal layers composed of wide and narrow layers in turn, which is narrower than the ground line of the uppermost layer, to connect the ground lines of the lowermost and uppermost layers.

These methods are unlike a conventional method of connecting ground lines of lowermost and uppermost layers using intermediate metal layers having the same width and via holes.

The present invention is also directed to a CPW that is capable of minimizing CPW loss and maximizing a slow wave effect by forming a patterned ground line in an intermediate metal layer as well as forming a slotted ground line or a patterned ground line in a lowermost metal layer to reduce loss caused by an image current, thereby improving performance of an ultra-high frequency circuit and miniaturizing the circuit.

One aspect of the present invention provides a CPW including an uppermost metal layer designed to have a ground line—a signal line—a ground line; an intermediate metal layer having a structure to maximize an area of electromagnetic wave propagation; and a lowermost metal layer used as a shield layer and connected to the ground line of the uppermost metal layer and the intermediate metal layer using via holes.

The intermediate metal layer may be formed of a plurality of intermediate metal layers disposed below the ground line of the uppermost metal layer, wherein the plurality of intermediate metal layers include at least one metal layer having a smaller width than the ground line.

The lowermost metal layer may include a slot pattern.

The plurality of intermediate metal layers may be spaced apart from each other and include a plurality of intermediate metal layer groups connecting the ground line of the uppermost layer and the lowermost metal layer.

The plurality of intermediate metal layers may gradually decrease in width from the ground line of the uppermost layer to the lowermost metal layer, and have a trapezoid-shaped cross-section. The plurality of intermediate metal layers may gradually increase in width from the ground line of the uppermost layer to the lowermost metal layer, and have an inverse trapezoid-shaped cross-section. And, the plurality of intermediate metal layers may have a structure that the wide and narrow metal layers are disposed in turn. The plurality of intermediate metal layers may have the same width which is smaller than that of the ground line of the uppermost layer.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF EXEMPLARY EMBODIMENTS

Hereinafter, exemplary embodiments according to the present invention will be described in detail with reference to accompanying drawings. The following embodiments will be provided to those skilled in the art to fully understand the present invention.

Figure 1:
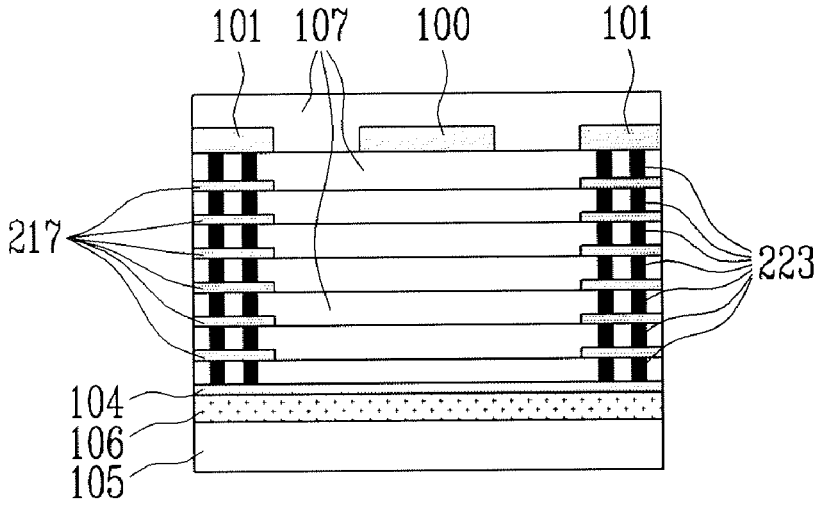
FIG. 1 (PRIOR ART)
FIG. 1 is a cross-sectional view of a conventional coplanar waveguide (CPW) using multi-layer interconnection CMOS technology.

FIG. 1 is a cross-sectional view of a conventional coplanar waveguide (CPW) using multi-layer interconnection CMOS technology.

As shown in FIG. 1, in the conventional CPW using multi-layer interconnection CMOS technology, an uppermost metal layer of an 8-level metal layer forms a signal line 100 and a ground line 101, and a lowermost metal layer 104 forms a shield layer. The uppermost and lowermost metal layers are grounded using intermediate metal layers 103 and via holes 108. Each of the intermediate metal layers 103 has the same width as the ground line 101 of the uppermost metal layer, and is connected to the lowermost metal layer 104. Each metal layer is separately disposed over a silicon substrate 105 and has interlayer insulators 106 and 107 interposed between the layers.

In the above-mentioned CPW, the lowermost metal layer is used as a shield layer using metal multi-layers, and the uppermost metal layer is designed as a CPW. The shield layer and the ground line of the uppermost layer are simply connected by the intermediate metal layers and the via holes, and, in general, the intermediate metal layers have the same width as the ground line of the uppermost layer and are constant in width.

In the CPW transmission line (TL), a structure and a distance between a signal line and ground lines have a sensitive effect on a transmission property. An example of a conventional CPW considering this is illustrated in FIG. 2.

Figure 2:
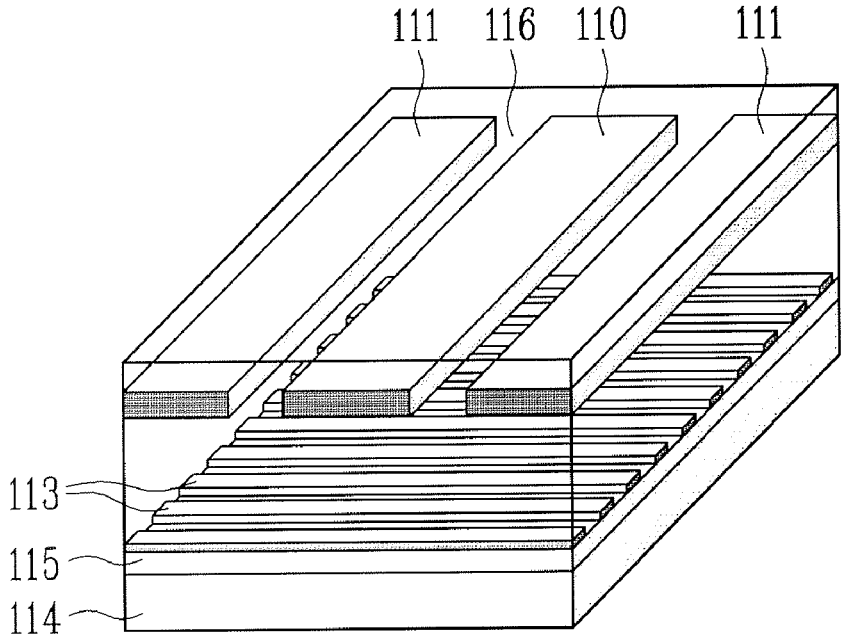
FIG. 2 (PRIOR ART)
FIG. 2 is a three-dimensional view of a conventional CPW to which a patterned ground shield is applied.

FIG. 2 is a three-dimensional view of a conventional CPW to which a patterned ground shield is applied.

Referring to FIG. 2, in the conventional CPW using multi-layer interconnection CMOS technology, an uppermost metal layer forms a signal line 110 and a ground line 111 and a lowermost metal layer 113 having patterns forms a ground. An interlayer insulator 115 is interposed between a silicon substrate 114 and the lowermost metal layer 113, and another interlayer insulator 116 are disposed between the lowermost metal layer 113 and the uppermost metal layer and over the uppermost metal layer.

In the CPW, it is not easy to interconnect between the uppermost ground lines 111 and the lowermost metal layer 113 because of the nature of its structure so it can be floated electrically. Thus, there is a demerit that the lowermost metal layer 113 acting as a ground line having a pattern is not clear in its role.

In consideration of problems of the conventional technique mentioned above, the present invention suggests various structures of an intermediate metal layer so as to electrically connect a lowermost shield layer with an uppermost ground line and to maximize a distance between a signal line and a ground line and an area where an electromagnetic wave spreads, and thus loss of electric waves is reduced and fidelity is improved.

To this end, the present invention provides a CPW having various shapes connected to a shield layer as well as having an intermediate metal layer whose width is different from that of a ground line of an uppermost layer. In addition, the present invention provides a CPW in which both the intermediate metal layer and the lowermost shield layer have slots or the lowermost shield layer has a slot as well.

Hereinafter, exemplary embodiments of the present invention will be described in detail with reference to the accompanying drawings. Like numbers refer to like elements throughout the drawings. In the drawings, the thickness of layers and regions are exaggerated for clarity. Detailed descriptions about a silicon substrate and an interlayer insulator will be omitted in each embodiment.

Figure 3:
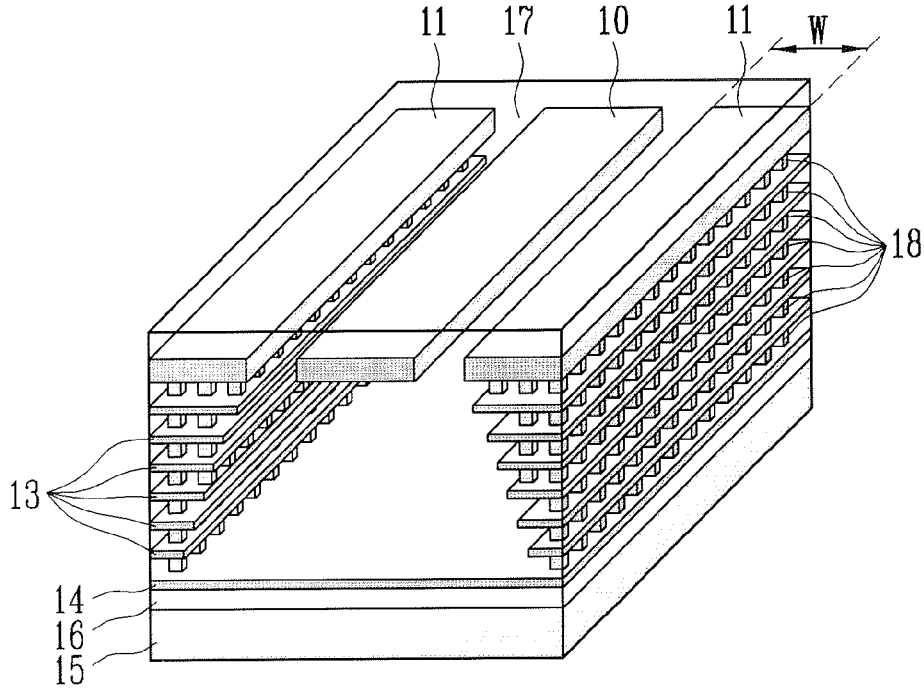
FIG. 3 is a three-dimensional view of a CPW having a trapezoid-shaped cross-section according to an exemplary embodiment of the present invention.

FIG. 3 is a three-dimensional view of a CPW having a trapezoid-shaped cross-section according to an exemplary embodiment of the present invention.

Referring to FIG. 3, in the design of the CPW having a trapezoid-shaped cross-section suggested by the present invention, in the case of employing an 8-level metal layer using 0.13 μm CMOS technology, an uppermost metal layer is designed to have a ground line 11—a signal line 10—a ground line 11, a lowermost metal layer is designed as a shield layer 14 to reduce an effect of a silicon substrate 15, and the shield layer 14 is connected to the ground line 11 of the uppermost layer using intermediate metal layers 13 and via holes 18. To be specific, in the above-mentioned CPW, the intermediate metal layers 13 gradually decrease in width with respect to a width W of the ground line 11 of the uppermost layer, and are connected to the shield layer 14. That is, the CPW in the embodiment has a ground around the signal line 10 formed in a trapezoid shape.

As such, a ground cross-section of a conventional multi-layer interconnection CPW is formed in a square shape, whereas the ground cross-section of the present invention has a trapezoid shape, so that the CPW has a larger area of electromagnetic wave propagation than the conventional square cross-section, thereby reducing transmission loss and improving fidelity.

Figure 4:
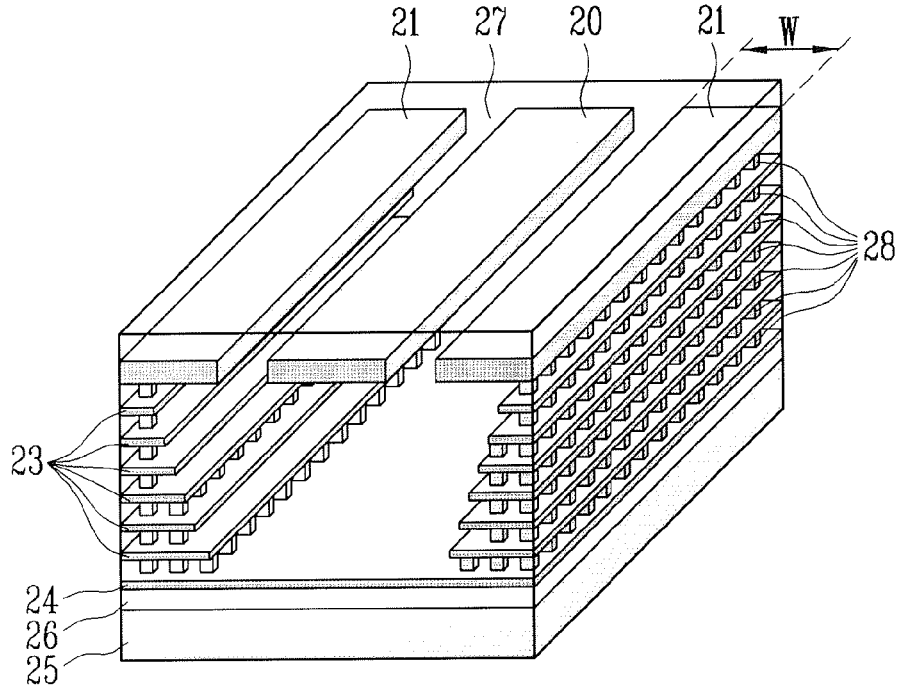
FIG. 4 is a three-dimensional view of a CPW according to another exemplary embodiment of the present invention.

FIG. 4 is a three-dimensional view of a CPW according to still another exemplary embodiment of the present invention.

Referring to FIG. 4, in the design of the CPW according to still another embodiment of the present invention, an uppermost metal layer is designed to have a ground line 21—a signal line 20—a ground line 21, a lowermost metal layer 24 is designed as a shield layer to reduce an effect of a silicon substrate 25, and the shield layer 24 is connected to the ground line 21 of the uppermost layer using intermediate metal layers 23 and via holes 28. To be specific, in the CPW of the embodiment, the intermediate metal layers 23 have a smaller width than a width W of the ground line 21 of the uppermost layer, gradually increase in width from the uppermost layer to the lowermost metal layer 24, and are connected to the lowermost shield layer 24.

The CPW of the present embodiment has a ground cross-section of an inverse trapezoid shape, which is similar to the CPW of the first embodiment described above. Thus, it has a larger area of electromagnetic wave propagation than a conventional CPW having a square-shaped cross-section. Accordingly, it exhibits reduced transmission loss and improved fidelity.

Figure 5:
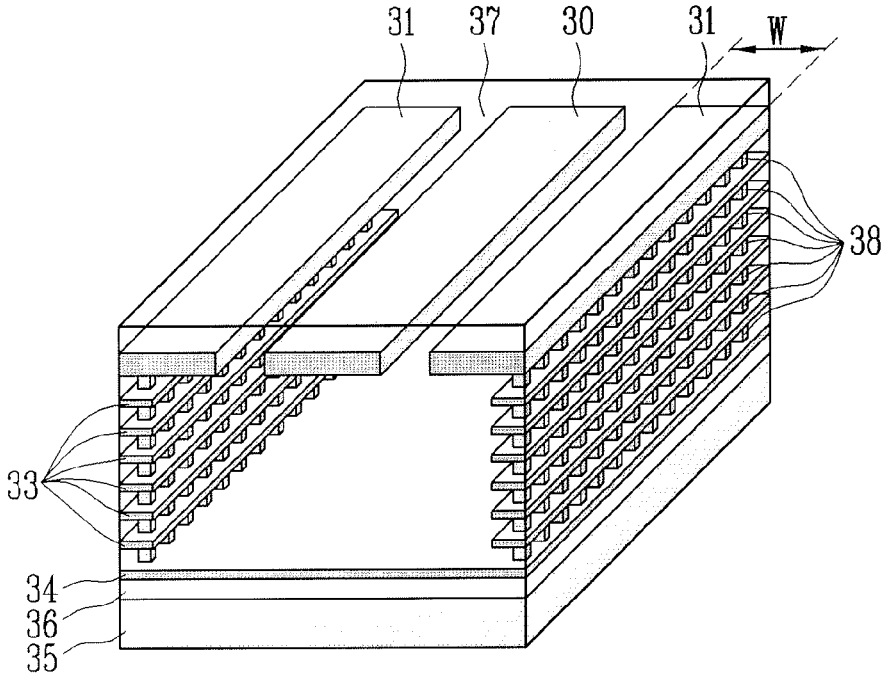
FIG. 5 is a three-dimensional view of a CPW according to still another exemplary embodiment of the present invention.

FIG. 5 is a three-dimensional view of a CPW according to yet another exemplary embodiment of the present invention.

Referring to FIG. 5, in the design of the CPW according to yet another embodiment of the present invention, an uppermost metal layer is designed to have a ground line 31—a signal line 30—a ground line 31, a lowermost metal layer 34 is designed as a shield layer to reduce an effect of a silicon substrate 35, and the shield layer 34 is connected to the ground line 31 of the uppermost layer using intermediate metal layers 33 and via holes 38. To be specific, in the CPW of the embodiment, the intermediate metal layers 33 have a smaller width than a width W of the ground line 31 of the uppermost layer and have the same length.

The CPW of the present embodiment has a ground cross-section of a square-shaped, which has a larger area of electromagnetic wave propagation than a conventional CPW having a squared-shaped cross-section. Thus, transmission loss is reduced and fidelity is improved.

Figure 6:
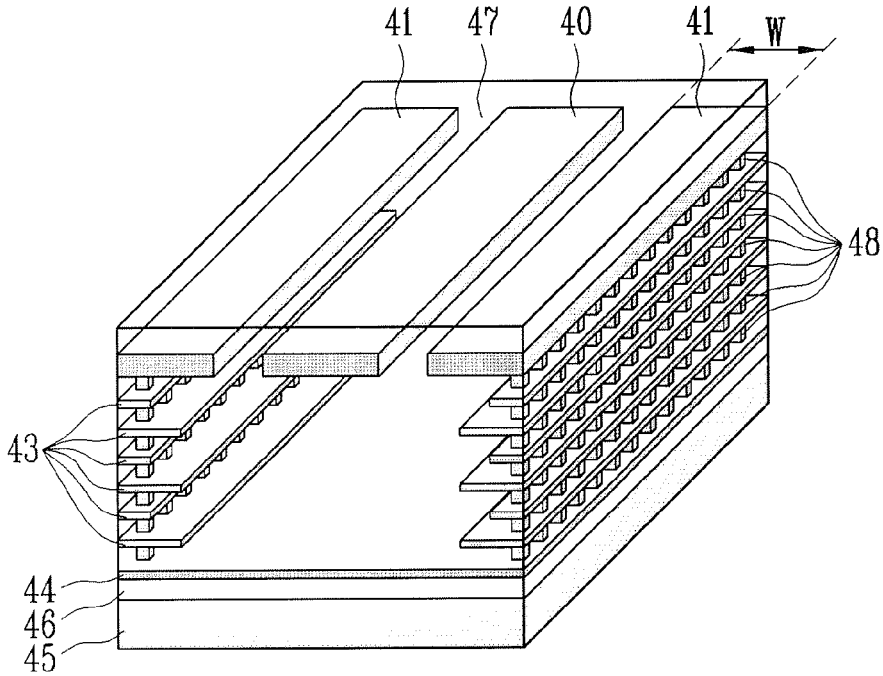
FIG. 6 is a three-dimensional view of a CPW according to yet another exemplary embodiment of the present invention.

FIG. 6 is a three-dimensional view of a CPW according to yet another exemplary embodiment of the present invention.

Referring to FIG. 6, in the design of the CPW according to yet another embodiment of the present invention, an uppermost metal layer is designed to have a ground line 41—a signal line 40—a ground line 41, a lowermost metal layer 44 is designed as a shield layer to reduce an effect of a silicon substrate 45, and the shield layer 44 is connected to the ground line 41 of the uppermost layer using intermediate metal layers 43 and via holes 48. To be specific, in the CPW of the embodiment, the intermediate metal layers 43 have a smaller width than a width W of the ground line 41 of the uppermost layer, and relatively narrow and wide intermediate metal layers 43 are disposed in turn and connected to the shield layer 44.

The CPW of the present embodiment has a function similar to a CPW having a slow-wave effect by forming a slot line on a shield layer, which will be described below. Thus, according to the CPW of the embodiment, transmission loss is reduced and fidelity is improved.

Figure 7:
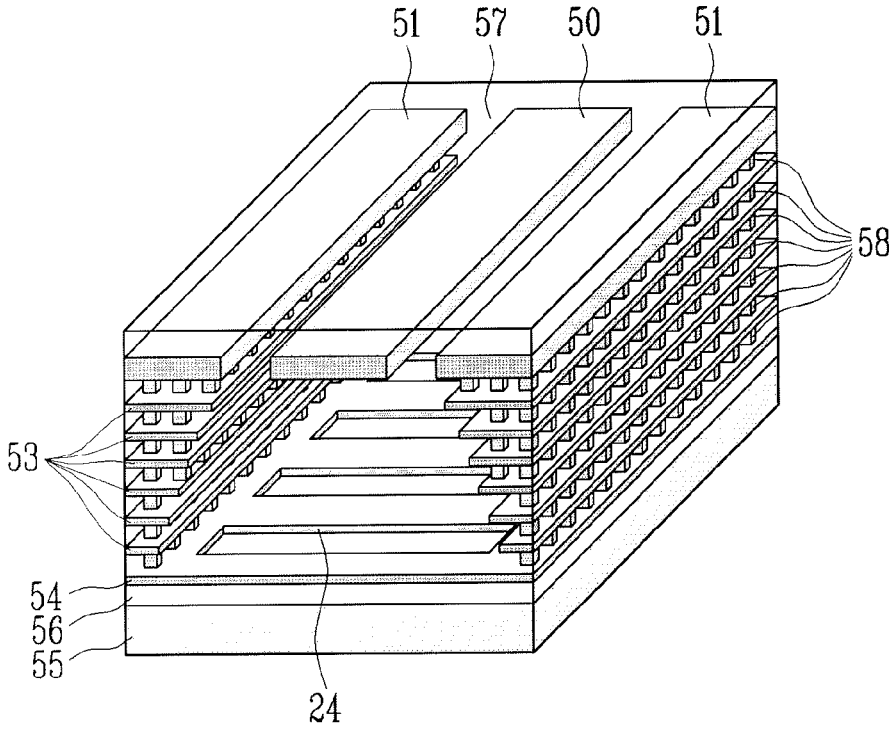
FIG. 7 is a three-dimensional view of a CPW according to yet another exemplary embodiment of the present invention.

FIG. 7 is a three-dimensional view of a CPW according to yet another exemplary embodiment of the present invention.

Referring to FIG. 7, in the design of the CPW according to yet another embodiment of the present invention, a slot pattern 59 is formed on a lowermost metal layer 54 for a slow-wave effect in addition to the CPW described with reference to FIG. 3.

To be specific, in the CPW of the embodiment, an uppermost metal layer of an 8-level metal layer is designed to have a ground line 51—a signal line 50—a ground line 51, a lowermost metal layer 54 is designed as a shield layer to reduce an effect of a silicon substrate 55, and the shield layer 54 is connected to the ground line 51 of the uppermost layer using intermediate metal layers 53 and via holes 58. The intermediate metal layers 53 gradually decrease in width from the ground line 51 of the uppermost layer to the lowermost shield layer 54, and are connected to the shield layer 54. Slot patterns 59 for a slow wave effect are formed in the shield layer 54.

Figure 8:
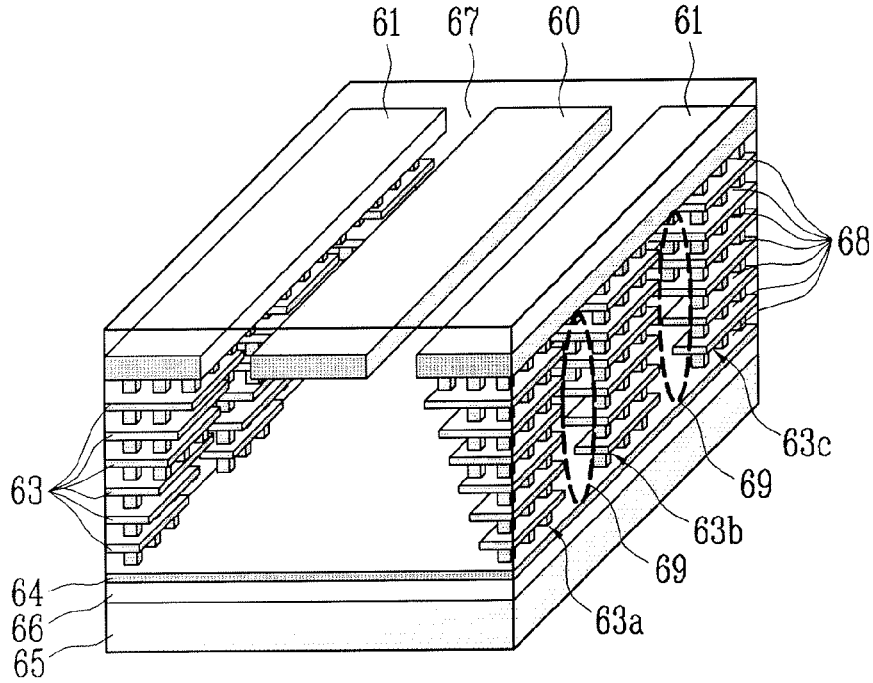
FIG. 8 is a three-dimensional view of a CPW according to yet another exemplary embodiment of the present invention.

FIG. 8 is a three-dimensional view of a CPW according to yet another exemplary embodiment of the present invention.

Referring to FIG. 8, in the design of the CPW according to yet another embodiment of the present invention, an uppermost metal layer of an 8-level metal layer is designed to have a ground line 61—a signal line 60—a ground line 61, a lowermost metal layer 64 is designed as a shield layer to reduce an effect of a silicon substrate 65, and the shield layer 64 is connected to the ground line 61 of the uppermost layer using intermediate metal layers 63 and via holes 68.

Compared to the CPW described with reference to FIG. 3, in the CPW of the embodiment having a trapezoid-shaped cross-section, the intermediate metal layers 63 connecting the ground line 61 and the shield layer 64 are not continuously connected, but it has a slot pattern 69. In other words, the intermediate metal layers 63 are spaced apart from each other and separately disposed into a plurality of intermediate metal layer groups 63*a*, 63*b* and 63*c* connecting the ground line 61 of the uppermost layer and the shield layer 64.

Figure 9:
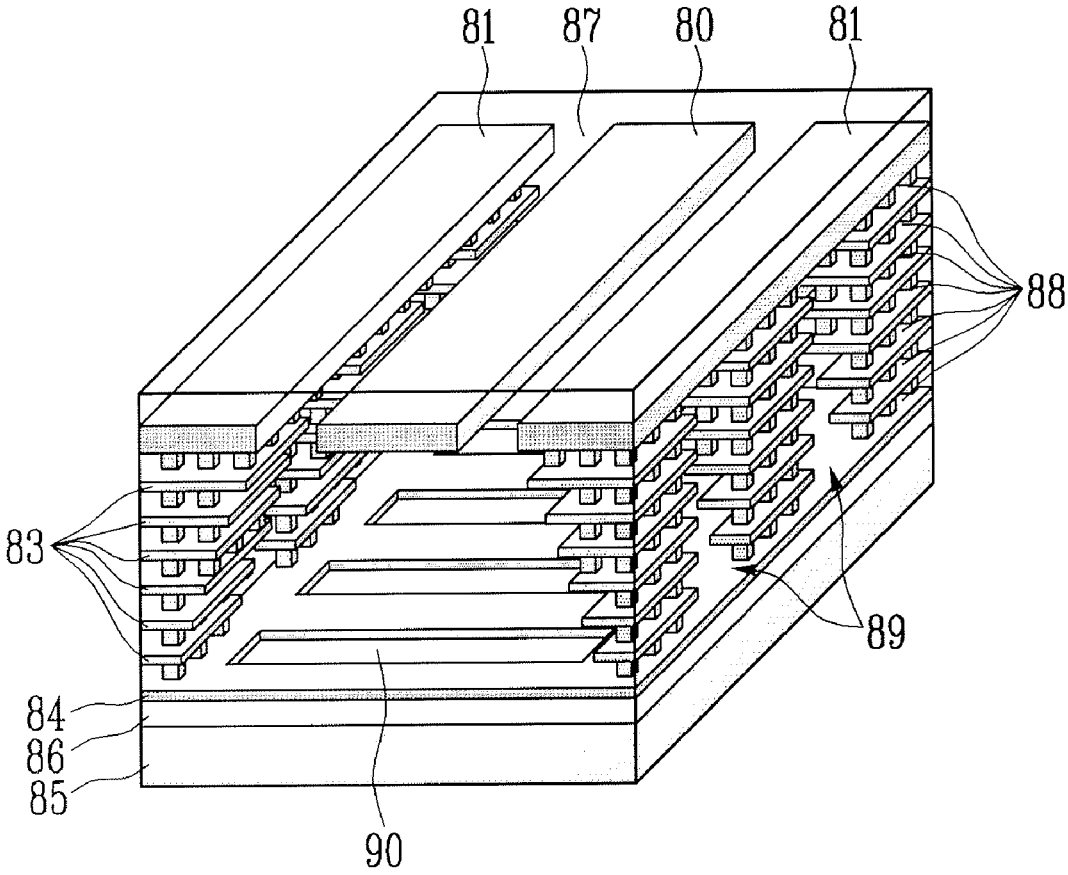
FIG. 9 is a three-dimensional view of a CPW according to yet another exemplary embodiment of the present invention.

FIG. 9 is a three-dimensional view of a CPW according to yet another exemplary embodiment of the present invention.

Referring to FIG. 9, the CPW according to yet another exemplary embodiment of the present invention has a combined structure of the CPWs of FIGS. 7 and 8 in addition to the structure having a trapezoid cross-section as shown in FIG. 3.

To be specific, in the design of the CPW of the embodiment, an uppermost metal layer of an 8-level metal layer is designed to have a ground line 81—a signal line 80—a ground line 81, a lowermost metal layer 84 is designed as a shield layer to reduce an effect of a silicon substrate 85, and the shield layer 84 is connected to the ground line 81 of the uppermost layer using intermediate metal layers 83 and via holes 88. Particularly, the CPW of this embodiment is designed such that the intermediate metal layers 83 connected to the ground line 81 of the uppermost layer and the shield layer 84 have first slot patterns 89 and the shield layer 84 have second slot patterns 90.

In the above-mentioned embodiment of the present invention, the intermediate metal layers have a smaller width than that of the ground line of the uppermost layer, and the widths of the intermediate metal layers are designed to gradually increase or decrease, or to be uneven. However, the present invention is not limited to these structures. The intermediate metal layers can decrease and then increase in width, and thus it can be implemented such that a ground cross-section of the CPW has an oval shape.

For convenience, the above embodiment has been described focusing on a structure in which the intermediate metal layer is narrower than the ground line of the uppermost layer. However, it is not limited to such a structure. When the intermediate metal layers gradually increase or decrease in width, the widest intermediate metal layer can have the same width as the ground line of the uppermost layer.

As can be seen from the foregoing, when a CPW is designed using multi-layer interconnection CMOS technology, in a method of connecting ground lines of uppermost and lowermost layers, an intermediate metal layer can be designed to gradually increase or decrease in width, or to be uneven so as to maximize an area of electromagnetic wave propagation, thereby minimizing CPW loss and maximizing a slow wave effect. As a result, the performance of an ultra-high frequency circuit can be improved and the circuit may be scaled down. In addition, when the CPW suggested by the present invention is applied to the design of the ultra-high frequency circuit, it is possible to implement a low-priced CMOS integrated circuit operating at an ultra-high frequency due to performance improvement of the ultra-high frequency circuit and circuit miniaturization caused by the slow wave effect.

While the present invention has been shown and described with reference to certain exemplary embodiments thereof, it will be understood by those skilled in the art that various changes in form and details may be made therein without departing from the spirit and scope of the present invention as defined by the appended claims.

What is claimed is:

1. A multi-metal coplanar waveguide (CPW) comprising:

an uppermost metal layer designed to have a ground line—a signal line—a ground line;

an intermediate metal layer having a structure to maximize an area of electromagnetic wave propagation; and a lowermost metal layer used as a shield layer and connected to the ground line of the uppermost metal layer and the intermediate metal layer using via holes, and wherein the intermediate metal layer is formed of a plurality of intermediate metal layers which gradually decrease in width from the ground line to the lowermost metal layer, and have trapezoid-shaped cross-sections.

2. The CPW of claim 1, further comprising:

a substrate supporting the uppermost metal layer, the plurality of intermediate metal layers and the lowermost metal layer; and an interlayer insulator interposed between the substrate and the lowermost metal layer and between the metal layers.

3. The CPW of claim 1, wherein the plurality of intermediate metal layers are disposed below the ground line of the uppermost metal layer, and wherein the plurality of intermediate metal layers comprise at least one metal layer having a smaller width than that of the ground line.

4. The CPW of claim 3, wherein the plurality of intermediate metal layers are spaced apart from each other and comprise a plurality of intermediate metal layer groups connecting the ground line and the lowermost metal layer.

5. The CPW of claim 3, wherein the lowermost metal layer comprises a slot pattern.

6. The CPW of claim 5, wherein the plurality of intermediate metal layers are spaced apart from each other and comprise a plurality of intermediate metal layer groups connecting the ground line and the lowermost metal layer.

* * * * *